United States Patent [19]

Olson

[11] Patent Number: 4,933,102

[45] **Date of Patent: * Jun. 12, 1990**

[54] SOLID CAST WAREWASHING COMPOSITION; ENCAPSULATED BLEACH SOURCE

[75] Inventor: Keith E. Olson, Apply Valley, Minn.

[73] Assignee: Ecolab Inc., St. Paul, Minn.

[ * ] Notice: The portion of the term of this patent subsequent to Apr. 14, 2006 has been disclaimed.

[21] Appl. No.: 296,844

[22] Filed: Jan. 12, 1989

Related U.S. Application Data

[63] Continuation of Ser. No. 84,923, Aug. 12, 1987, abandoned.

[51] Int. Cl.[5] ..... C11D 3/08; C11D 7/14; D06L 3/16

[52] U.S. Cl. ..... 252/174; 252/90; 252/91; 252/99; 252/174.13; 252/186.35; 252/186.36; 252/186.37

[58] Field of Search ..... 252/174, 135, 90, 99, 252/134

[56] References Cited

U.S. PATENT DOCUMENTS

| | | | |
|---|---|---|---|
| 2,333,444 | 2/1943 | Robinson | 252/135 |
| 3,649,545 | 3/1972 | Susuki | 252/174 |
| 4,569,780 | 2/1986 | Fernholz et al. | 252/90 |
| 4,569,781 | 2/1986 | Fernholz | 252/92 |
| 4,657,784 | 4/1987 | Olson | 427/13 |
| 4,681,914 | 7/1987 | Olson et al. | 252/91 |
| 4,830,773 | 5/1989 | Olson | 252/174.13 |

*Primary Examiner*—A. Lionel Clingman

*Attorney, Agent, or Firm*—Merchant, Gould, Smith, Edell, Welter & Schmidt

[57] ABSTRACT

Solid cast detergent-containing articles are produced for use in automatic washing machines. A liquid detergent composition is cast into a mold where it is allowed to solidify. The cast detergent composition includes alkali metal metasilicate, alkali metal condensed phosphate, an encapsulated bleaching source, and water for hydration. The composition optionally further includes a dye, a perfume, a surfactant, a defoamer, an additional sequestering agent such as an alkali metal salt of a polyacrylic compound, a neutral soluble salt such as an alkali metal sulphate or an alkali metal chloride, an alkali compound such as an alkali metal hydroxide, an alkali metal sesquicarbonte, an alkali metal borate, or mixtures thereof.

37 Claims, No Drawings

SOLID CAST WAREWASHING COMPOSITION; ENCAPSULATED BLEACH SOURCE

This is a continuation of application Ser. No. 7/084,923, filed Aug. 12, 1987 now abandoned.

FIELD OF THE INVENTION

A first aspect of this invention relates to solid cast detergent compositions which are particularly useful in home, industrial and institutional warewashing machines. A second aspect of this invention relates to methods for producing the detergent compositions. A third aspect of this invention relates to methods for using the detergent compositions.

BACKGROUND OF THE INVENTION

Warewashing compositions are typically available in liquid or granular form. While these forms have many advantages such as ease of manufacture, rapid dissolution rate and customer acceptance, they also have numerous drawbacks including stratification or settling of individual components, limits to the percent of active ingredients which may be incorporated, and instability of reactive components such as defoamers, surfactants, bleaches, etc. Further, liquid and granular warewashing compositions are easily spilled onto skin, clothing, etc. where they may cause injury and/or damage.

Accordingly, a need exists for a solid cast warewashing composition having a high concentration of active ingredients and an effective bleach source which is capable of being accurately, safely and efficiently dispersed into automatic warewashing machines.

BRIEF DISCUSSION OF THE INVENTION

I have discovered that a stable, substantially nonaqueous readily soluble, effective bleach-containing, solid cast warewashing detergent composition can be formed by combining hydratable, crystalline alkali metal silicate and water under conditions sufficient to cause substantially complete hydration of the silicate, and then combining an effective cleaning and glass protecting proportion of the hydrated silicate with an effective hardness sequestering proportion of a hydrated alkali metal condensed phosphate having sufficient water of hydration to allow the cast composition to solidify and an effective cleaning, bleaching and sanitizing proportion of a cellulose ether encapsulated bleaching source.

I have further discovered that effective cleaning solutions can be readily formed on demand from the solid block of warewashing composition by directing a solvent spray at least one surface of the cast composition.

All references herein to wt-% alkali metal silicate are based upon an anhydrous basis unless otherwise stated.

DETAILED DISCUSSION OF THE INVENTION

Broadly, the solid cast warewashing composition of this invention comprises water, hydratable, crystalline alkali metal silicate, alkali metal condensed phosphate, cellulose ether encapsulated bleach, and optionally, dye, perfume, surfactant, defoamer, an additional sequestering agent such as an alkali metal salt of a polyacrylic acid, a neutral soluble salt such as an alkali metal sulphate or an alkali metal chloride, and/or alkali compound.

Alkali Metal Silicate

The solid cast warewashing composition contains about 20 to 55 wt-% hydratable, crystalline alkali metal silicate, preferably 20 to 40 wt-%. Alkali metal silicates are the reaction product of an alkali metal oxide ($M_2O$) and silicon dioxide ($SiO_2$) and have the general chemical formula $(M_2O)_x:(SiO_2)_y$ wherein x and y indicate the molar ratio of alkali metal oxide to silicon dioxide.

Methods of manufacturing alkali metal silicates having various x:y mole ratios are well known as demonstrated by the general disclosure in Kirk-Othmar Encyclopedia of Chemical Technology, 2d Ed., Vol. 18, pp. 139–141. The desired properties and benefits of the solid cast warewashing composition described herein can be obtained using an alkali metal silicate having an x:y ratio of about 1:1–3:1, preferably 1:1. At these ratios, the alkali metal silicate has sufficient alkaline character to clean effectively and sufficient silicon dioxide to protect aluminum, china, glassware, etc. from the etchant effect of basic components in the composition. These silicates also have excellent solidification properties.

For reasons of high cleaning performance, delicate ware protection and low cost, the most preferred alkali metal silicate is sodium metasilicate having an $Na_2O$:-$SiO_2$ ratio of about 1:1.

Alkali Metal Condensed Phosphate

The solid cast warewashing composition contains about 1 to 70 wt-% hydrated alkali metal condensed phosphate as a detergent builder and hardness sequestrant, preferably 15 to 40 wt-%.

The service water commonly employed in cleaning baths contains substantial proportions of hardness ions most commonly calcium and magnesium ions, which can react with detergent components to decrease cleansing effectiveness and/or leave unsightly deposits upon the substrate being cleaned. Sequestrants act to prevent or delay crystal growth of calcium or magnesium compounds and thereby eliminate their reaction with other components and/or their precipitation.

Condensed phosphate compositions useful in this invention include the water soluble alkali metal orthophosphates, polyphosphates, pyrophosphates and metaphosphates. It may be possible to employ some condensed phosphate in an anhydrous state and still have the cast composition solidify quickly. However, it has been found that the use of an anhydrous alkali metal tripolyphosphate results in a cast composition that takes over a day to solidify.

It is preferable that the cast composition solidify as quickly as possible. If the cast composition takes too long to solidify, the encapsulated chlorine source, which is water soluble, breaks down releasing chlorine. Thus, the quicker the solidification of the cast composition, the higher the percentage of chlorine retained in the cast composition. A preferred time for solidification would be about 2 hours or less. It is preferable that if an alkali metal tripolyphosphate is used in this invention that it have a water of hydration greater than about 15 wt-% based upon the alkali metal tripolyphosphate composition in order for the cast composition to solidify quickly.

For reasons of product performance, the preferred condensed phosphate composition is sodium tripolyphosphate having a water of hydration greater than about 15 wt-% prior to its addition to the other component. While both granular and powdered condensed phosphate compositions can be usefully employed in the present invention, granular condensed phosphates, having a particle size of about 10 to 40 U.S. Mesh, are preferred to reduce the product viscosity during processing.

Encapsulated Chlorine Source

The solid cast warewashing composition of this invention contains about 0.1 to 20 wt-%, preferably 0.1 to 15 wt-%, of an encapsulated bleach. The bleach is coated with a first or inner coating of a separating water soluble compound and a second or outer coating of a cellulose ether.

BLEACHING AGENT

Bleaches suitable for use as the core component include any of the well known bleaching agents capable of removing stains from such substrates as dishes, flatware, pots and pans, textiles, countertops, appliances, flooring, etc. without significantly damaging the substrate. A nonlimiting list of such bleaches includes active chlorine releasing bleaches such as hypochlorites, chlorites, chlorinated phosphates, chloroisocyanates, chloroamines etc.; and peroxide compounds such as hydrogen peroxide, perborates, percarbonates etc. Preferred bleaches include those bleaches which liberate an active halogen species such as $Cl^+$, $Br^+$, $OCl^-$, $OBr^-$ under conditions normally encountered in typical cleaning processes. Most preferably, the bleaching agent releases $Cl^+$ or $OCl^-$. A nonlimiting list of useful chlorine releasing bleaches includes calcium hypochlorite, lithium hypochlorite, chlorinated trisodium phosphate, sodium dichloroisocyanurate, potassium dichloroisocyanurate, [(monotrichloro)-tetra(monopotassium dichloro)] pentaisocyanurate, trichloromelamine, sulfondichloro-amide, 1,3-dichloro-5,5-dimethyl hydantoin, n-chlorosuccinimide, n,n'-dichloroazodicarbonimide, n,n-chloroacetyl urea, n,n'-dichlorobiuret, chlorinated dicyanamide, trichlorocyanuric acid, and hydrates thereof.

Because of their higher activities and high bleaching efficiencies the most preferred bleaching agents are the alkali metal salts of chloroisocyanurates and the hydrates thereof.

SEPARATING COMPOUNDS

Compounds suitable for use as the inner coating component include any separating compound which is solid at those temperatures likely to be encountered during storage of the encapsulated bleach (i.e. −5° to 50° C.), is chemically compatible with (i.e. does not react with) either the bleaching agent core or the water soluble cellulose ether outer coating, and is capable of separating the bleaching agent from the cellulose ether so as to prevent deactivation of the bleach by the cellulose ether. Useful separating compounds include specifically but not exclusively water insoluble compounds such as $C_{11-30}$ fatty acids, waxes and water soluble compounds such as alkyl sulfonates, alkyl sulfates, detergent builders and detergent fillers. Because of their ability to readily release the bleach core under conditions typically encountered during detergent use, the water soluble compounds are preferred. Most preferably, the separating compound is an inorganic detergent builder or filler useful in the cleaning composition into which the bleach is to be employed. A nonlimiting list of such detergent builders and fillers includes inorganic compounds such as sodium sulfate, sodium chloride, tetrasodium pyrophosphate, alkali metal silicates, tetrapotassium pyrophosphate, pentasodium tripolyphosphate, pentapotassium tripolyphosphate, sodium sequicarbonate, potassium sequicarbonate, phytates, etc. Because of their low cost, ease of availability, ease of use and efficient detergent building properties the inner coating compound preferably comprises a mixture of sodium sulfate and a tripolyphosphate.

WATER SOLUBLE CELLULOSE ETHERS

Cellulose is a linear polymer of anhydroglucose units held together by glucosidic linkages. Each anhydroglucose unit contains three hydroxyl groups—one primary and two secondary. Cellulose derivatives such as cellulose ethers are formed by reaction of the cellulose with a chemical reagent at these hydroxyl groups. For example, hydroxyethylcellulose can be prepared by the reaction of alkali cellulose with ethylene oxide in the presence of isopropanol, tert-butanol or acetone in accordance with the following equation:

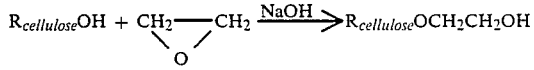

Cellulose derivatives useful as the outer coating component in the present invention are the water soluble cellulose ethers selected from the group consisting of $(C_{1-4})$ alkyl cellulose, carboxy $(C_{1-4})$ alkyl cellulose, hydroxy $(C_{1-4})$ alkyl cellulose, di$(C_{1-4})$ alkyl carboxy $(C_{1-4})$ hydroxy $(C_{1-4})$ cellulose, $(C_{1-4})$ alkyl hydroxy $(C_{1-4})$ alkyl cellulose and mixtures thereof. For reasons of bleach stabilizing performance and ease of application, the preferred cellulose ethers are the hydroxy $(C_{1-4})$ alkyl celluloses with the most preferred cellulose ethers being hydroxyethylcellulose and hydroxypropylcellulose.

In most commercially available cellulose derivatives, some of the hydroxyl groups are not substituted. The number of unsubstituted hydroxyl groups is known as the degree of substitution (DS) and is designated by a number from 0 to 3 which represents the average number of hydroxyl groups, of the three available in the anhydroglucose unit, that have been substituted.

A special problem arises in the expression of degree of substitution for hydroxyalkyl derivatives because each time a hydroxyalkyl substituent is added, a new reactive hydroxyl group is formed and the number of reactive hydroxyl sites does not change. The result is the formation of side chains, as shown below:

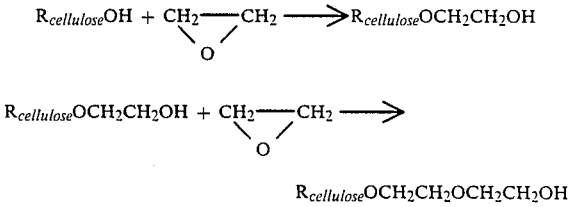

To describe the extent of the formation of side chains the term MS has been coined. MS is defined as the number of moles of reagent (i.e. ethylene oxide) combined per anhydroglucose unit.

The ratio of DS to MS is an indication of the average length of the side chains developed. The DS, MS and ratio of DS to MS can affect the chemical properties of the cellulose derivative and only those cellulose ethers that have a DS, MS and DS:MS which result in a water soluble compound may be usefully employed in the present invention.

The DS of several useful cellulose ethers are set forth below:

TABLE 1

| Cellulose | Typical DS | Preferred DS |
|---|---|---|
| Hydroxymethyl | 0–2.6 | 1.3–2.6 |
| Hydroxyethyl | 0–3 | 1.2–3 |
| Hydroxypropyl | 1.4–3 | 1.4–3 |
| Carboxymethyl | 0.4–1.4 | 0.7–0.9 |

The composition can comprise about 20 to 90 wt-%, preferably about 40 to 70 wt-% bleach core, about 5 to 60 wt-%, preferably about 10 to 50 wt-% separating compound inner coating and about 1 to 25 wt-%, preferably about 2 to 10 wt-% water soluble cellulose ether outer coating.

While not intending to be limited thereby I believe that the water soluble cellulose ethers described herein are capable of protecting a bleaching agent core from deactivation in an alkaline environment because the cellulose ethers are water insoluble when in the presence of at least about 10–50 wt-% inorganic salts such as sodium chloride, sodium sulphate, sodium perborate, etc. (i.e. those conditions typically encountered in solid detergents) and water soluble only when the wt-% of inorganic salt falls outside these levels (i.e. those conditions typically encountered during use of the detergent).

ENCAPSULATION PROCEDURE

The bleach may be encapsulated in any convenient manner capable of ensuring complete coating of the bleach. Obtaining a complete protective coating with the cellulose ether is simplified by the tendency of cellulose ethers to naturally form a nonporous, evenly distributed coating on a particle. For reasons of low manufacturing cost and ease of manufacture the bleach is preferably encapsulated in a fluidized bed as set forth in detail in the Examples. Briefly, the separating composition is dissolved in an appropriate solvent, such as water when water soluble, to form an inner coating solution; the water soluble cellulose ether dissolved in water to form an outer coating solution; the bleach particles fluidized in a fluidized bed apparatus, the inner coating solution sprayed onto the fluidized particles and dried, and the outer coating solution sprayed on the fluidized particles and dried.

Water

The solid cast warewashing composition contains about 8 to 60 wt-%, preferably 8 to 35 wt-% water in addition to the water of hydration in the hydrated alkali metal condensed phosphate and other components of the cast composition. The water is necessary to form a homogeneous mixture capable of being cast and solidified.

The use of the term "water" in reference to the cast composition refers to water added as free water and not water added as water of hydration unless otherwise specified.

Other Components

In addition to those components previously described, other conventional detergent components and fillers can be included in the solid cast warewashing composition including a defoamer, a secondary sequestrant such as a polyacrylate, an alkali compound, a detergent builder or filler, a dye and perfume.

A defoamer is a chemical compound with a hydrophobe/hydrophile balance suitable for reducing the stability of protein foam. The hydrophobicity can be provided by an oleophilic portion of the molecule; e.g., an aromatic alkyl or aralkyl group, an oxypropylene unit or oxypropylene chain, or other oxyalkylene functional groups other than oxyethylene; e.g., tetramethylene oxide. The hydrophilicity can be provided by oxyethylene units, chains, blocks and/or ester groups; e.g., organophosphate esters; salt-type groups, or salt-forming groups. Typically, defoamers are nonionic organic surface-active polymers having hydrophobic groups, blocks or chains and hydrophilic ester groups, blocks, units or chains; but anionic, cationic, and amphoteric defoamers are known. For a disclosure of nonionic defoaming surfactants, see U.S. Pat. No. 3,048,548, issued Aug. 7, 1962 (Martin et al), U.S. Pat. No. 3,334,147, issued Aug. 1, 1967 (Brunelle et al), and U.S. Pat. No. 3,442,242, issued May 13, 1969 (Rue et al). Phosphate esters are also suitable, e.g. esters of the formula $RO\text{-}(PO_3M)\text{-}_nR$, wherein n is a number ranging from 1 to about 60, typically less than 10 for cyclic phosphates, M is an alkali metal and R is an organic group or M, with at least one R being an organic group such as an oxyalkylene chain. The solid cast warewashing composition of this invention can include about 0 to 15 wt-% of a defoamer.

The solid cast warewashing composition can employ a polyelectrolyte such as the polyacrylates of molecular weight 1000–3000 as secondary chelating or sequestering agent. See, for example, U.S. Pat. No. 3,535,285, issued Oct. 20, 1970 (Sabatelli et al), U.S. Pat. No. 3,579,455, issued May 18, 1971 (Sabatelli et al), U.S. Pat. No. 3,700,599, issued Oct. 24, 1972 (Mizuno et al), and U.S. Pat. No. 3,899,436, issued Aug. 12, 1975 (Copeland et al). As is known in the art, polyacrylates (particularly alkali metal salts of polyacrylic acid and its copolymers) can function as thickeners in aqueous systems. Cast detergent compositions of this invention can contain up to 20% by weight of a secondary sequestering agent in combination with the alkali metal condensed phosphates.

An alkali compound may also be included in the solid cast warewashing composition of this invention. Examples of useful alkalis include but are not limited to alkali metal hydroxides, soluble alkali metal silicates with the formula $(M_2O)_x:(SiO_2)_y$ wherein M is an alkali metal and the ratio of x:y is about 1.0:1.6 to 1.0:3.75, alkali metal carbonates, alkali metal bicarbonates, alkali metal sesquicarbonates, and alkali metal borates. Up to 30% of such alkali compounds may be included in the solid cast warewashing composition.

In addition, the cast composition can contain 0–15 wt-% of a surfactant for cleaning purposes. Types of surfactants which can be used include nonionic, anionic, cationic, and amphoteric surfactants, preferably nonionic surfactants.

A neutral soluble salt may also be included in the warewashing composition. Neutral soluble salts are typically the reaction product of a strong acid and a strong base including sodium sulfate, sodium chloride and others. Up to 20 wt-% of a neutral soluble salt may be included in the warewashing composition.

The cast composition may further comprise up to 10 wt-% of a dye and up to 10 wt-% of a perfume.

Method of Manufacturing Cast Detergent

While the following process is described with reference to specific components, it should be understood that other components and similar processes can be used to form a detergent solution which can be cast into a mold and will solidify upon hydration of its hydratable component. A particularly useful detergent composition of this invention is formed by heating an aqueous composition comprising about 8.0 to 60 wt-%, preferably 8 to 35 wt-% water and about 20 to 55 wt-% alkali metal metasilicate in a reaction vessel to about 35° to 99° C., preferably 65° to 85° C. The composition is held at said temperature range for about 15 minutes to two hours to form an alkali metal metasilicate hydrate. The temperature of the composition is then allowed to fall below about 65° C. by cooling.

About 1 to 70 wt-% of a hydrated alkali metal condensed phosphate having water of hydration sufficient to increase the rate of the solidification of the cast composition is added to the composition to form a suspension. The suspension is cooled to a temperature below about 55° C., preferably about 48° to 55° C. The suspension is cast in a mold with about 0.1 to 20 wt-% of the encapsulated bleaching source which is mixed into the suspension prior to casting or co-added while pouring the suspension into the mold. The composition is then cooled. As the mixture continues to cool, it solidifies to form a cast composition.

In order to obtain a controlled and rapid solidification of the cast product, which is preferred for production and quality successful reasons, the hydration of the metasilicate should be held at a high temperature. In addition, no interfering ions should be present in the liquid metasilicate solution/slurry. The preparation of the cast composition is conducted in such a manner as to limit as much as possible the amount of condensed phosphate which dissolves and introduces itself into the crystallizing mass. A slurry of condensed phosphate is preferred.

Optional components, including a dye, a perfume, a surfactant, a defoamer, an additional sequestrant such as an alkali metal salt of a polyacrylic compound, a neutral soluble salt, an alkali, or mixtures thereof, can also be included in the composition before solidification.

A dye can be added anytime after the hydration of the metasilicate. A perfume can be added at the same time as the encapsulate or just prior to casting, since excessive heat destroys perfumes. A surfactant can be added anytime after the hydration of the metasilicate. An additional sequestering agent such as an alkali metal salt of a polyacrylic acid compound can be added anytime after the hydration of the metasilicate, preferably prior to the addition of the encapsulate. A neutral soluble salt such as an alkali metal chloride or an alkali metal sulfate can be added anytime after the hydration of the metasilicate. A defoamer can be added anytime after the hydration of the metasilicate. An alkali metal compound selected from the group consisting of alkali metal hydroxides, soluble alkali metal silicates of the formula $(M_2O)_x:(SiO_2)_y$ wherein M is an alkali metal and the ratio of x:y is about 1.0:1.6 to 1.0:3.75, alkali metal carbonates, alkali metal bicarbonates, alkali metal sesquicarbonates, alkali metal borates and mixtures thereof can be added anytime after the hydration of the metasilicate.

It is important in the production of the cast composition that the cast composition solidify quickly since the chlorine encapsulate coating can dissolve in the added water.

The present invention will be further understood by reference to the following specific Examples which are illustrative of the composition, form and method of producing the solid, cast detergent-containing article of this invention. It is to be understood that many variations of composition, form and method of producing the cast detergent would be apparent to those skilled in the art. The following Examples, wherein parts and percentages are by weight, unless otherwise indicated, are only illustrative.

EXAMPLE 1

Into a 2 liter reaction vessel, provided with a stirring means and a heating means, was charged 23.33 wt-% of substantially demineralized water followed by 35.42 wt-% of anhydrous sodium metasilicate. The contents of the reaction vessel were then heated to 82° C. The contents of the reaction vessel were held at this temperature for 70 minutes until hydrated metasilicate formed. The temperature of the contents was then allowed to fall below 65° C. by cooling. 41.25 wt-% of a premix of 95.32 wt-% of large granular hydrated sodium tripolyphosphate and 4.68 wt-% of a surfactant premix of 86 wt-% of a nonionic ethylene propylene oxide block copolymer terminated with propyleneoxide and 14 wt-% of a mono and dialkyl acid phosphate ester rich in $C_{16}$ was then added to the reaction vessel. The tripolyphosphate had a water of hydration of 19.42 wt-%. The contents became viscous at this point. The contents were then cooled to 56° C. while being mixed. The contents were then poured into a 0.1 liter container simultaneously with 2.5 wt-% of the encapsulated chlorine source made in accordance with Example 6. The contents of the container were mixed for about 10 seconds. The contents were then solidified in the container in about 30 minutes.

EXAMPLE 2

Into a 2 liter reaction vessel, provided with a stirring means and a heating means, was charged 23.33 wt-% of substantially demineralized water followed by 35.42 wt-% of anhydrous sodium metasilicate. The contents of the reaction vessel were then heated to 34° C. The contents of the reaction vessel were held at this temperature for 69 minutes until hydrated metasilicate formed. The temperature of the contents was then allowed to fall below 66° C. by cooling. 41.25 wt-% of a premix of 95.32 wt-% of large granular hydrated sodium tripolyphosphate and 4.68 wt-% of a surfactant premix of 86 wt-% of a nonionic ethylene propylene oxide block copolymer terminated with propyloxide and 14 wt-% of a mono and dialkyl acid phosphate ester rich in $C_{16}$ was then added to the reaction vessel. The tripolyphosphate had a water of hydration of 19.42 wt-%. The contents became viscous at this point. The contents were then cooled to 53° C. while being mixed. The contents were then poured into a 0.1 liter container simultaneously with 2.5 wt-% of the encapsulated chlorine source made in accordance with Example 7. The contents of the container were mixed for about 10 seconds. The contents were then solidified in the container in about 20 minutes.

EXAMPLE 3

Into a 2 liter reaction vessel, provided with a stirring means and a heating means, was charged 23.33 wt-% of substantially demineralized water followed by 35.42 wt-% of anhydrous sodium metasilicate. The contents of the reaction vessel were then heated to 89° C. The contents of the reaction vessel were held at this temperature for 57 minutes until hydrated metasilicate formed. The temperature of the contents was then allowed to fall below 66° C. by cooling. 41.25 wt-% of a premix of 95.32 wt-% of large granular hydrated sodium tripolyphosphate and 4.68 wt-% of a surfactant premix of 86 wt-% of a nonionic ethylene propylene oxide block copolymer terminated with propyloxide and about 14 wt-% of a mono and dialkyl acid phosphate ester rich in $C_{16}$ was then added to the reaction vessel. The tripolyphosphate had a water of hydration of 19.42 wt-%. The contents became viscous at this point. The contents were then cooled to 52° C. while being mixed. The contents were then poured into a 0.1 liter container simultaneously with 2.5 wt-% of the encapsulated chlorine source made in accordance with Example 8. The contents of the container were mixed for about 10 seconds. The contents were then solidified in the container in about 30 minutes.

EXAMPLE 4

Into a reaction vessel, provided with a stirring means and a heating means, was charged 23.49 parts of substantially demineralized water followed by 35.67 parts of anydrous sodium metasilicate. 39.92 parts of large granular hydrated sodium tripolyphosphate having a particle size of 10 to 40 U.S. Mesh was then added to the reaction vessel. 1.62 parts of a surfactant premix of about 86 wt-% of a nonionic ethylene propylene oxide block copolymer terminated with propyloxide and about 14 wt-% of a mono and dialkyl acid phosphate ester rich in $C_{16}$ was added to the composition. 2.00 parts of a 50% active solution of polyacrylic acid having a molecular weight of 4,800–7,000, was added to the reaction vessel at this time. The formula comprised 105.20 total parts. The contents became viscous at this point. The contents were then poured into a 0.1 liter container simultaneously with 2.5 wt-% of the encapsulated chlorine source and mixed. The encapsulated chlorine source used was made in accordance with Example 9. The mixture was then solidified in the container in 30 minutes. The percentage of available chlorine present in the cast composition after 2 to 3 weeks at room temperature was 84.92%

EXAMPLE 5

Into a reaction vessel, provided with a stirring means and a heating means, was charged 23.49 parts of substantially demineralized water followed by 35.67 parts of anydrous sodium metasilicate. 50.00 parts of large granular hydrated sodium tripolyphosphate, having a particle size of 10 to 40 U.S. Mesh was then added to the reaction vessel. A surfactant premix of 14 wt-% of a defoamer which is a mixture of mono and dialkyl acid phosphates esters rich in $C_{16}$ and 86 wt-% of a nonionic ethylene propylene oxide block copolymer terminated with propylene oxide was added to the reaction vessel. 1.90 parts of sodium hydroxide beads were then added to the reaction vessel. The composition comprised 115.18 total parts. The contents were then poured into a 0.1 liter container simultaneously with 2.5 wt-% of the encapsulated chlorine source. The encapsulated chlorine source was made in accordance with Example 9. The contents of the container were mixed in the container. The mixture was then solidified in the container in 45 minutes. The percentage of available chlorine present in the cast composition after 2 to 3 weeks at room temperature was 84.92%.

EXAMPLE 6

Into a 32 liter container was placed 5.96 kg granular sodium sulfate, 1.62 kg sodium tripolyphosphate and 23.76 kg water to form a first coating, solution.

Into a fluidized bed was placed 14.59 kg of granular dichloroisocyanurate dihydrate (hereinafter bleach) which can be purchased from a number of sources. The bleach was fluidized with air and the bed heated to 68°–74° C. The entire amount of first coating solution was sprayed onto the bleach granules through a Gustav Schlick Nozzle, Model 941, at an atomized air pressure of 40 psig to form once coated bleach particles.

Into the now empty 32 liter container was placed 1.14 kg KLUCEL J, a hydroxypropylcellulose purchased from Hercules, Inc., and 34.47 kg water to form a second coating solution. The bed temperature was adjusted to 71°–72° C. and the entire amount of second coating solution sprayed onto the once coated bleach particles through the Gustav Schlick nozzle to form twice coated, protectively encapsulated bleach particles. The bed temperature was then adjusted to 74° C. and the protectively encapsulated bleach particles dried. The process yielded 23.15 kg of protectively encapsulated bleach particles comprising 60 wt-% core of dichloroisocyanurate monohydrate bleach, 35 wt-% first coat of a mixture of 75 wt-% sodium sulfate and 25 wt-% sodium tripolyphosphate hexahydrate and 5 wt-% second coat of KLUCEL J.

EXAMPLE 7

Into a 32 liter container was placed 5.96 kg granular sodium sulfate, 1.62 kg sodium tripolyphosphate and 23.78 kg water to form a first coating solution.

Into a fluidized bed was placed 13.43 kg of granular dichloroisocyanurate dihydrate (hereinafter bleach) which can be purchased from a number of sources. The bleach was fluidized with air and the bed heated to 72°–74° C. The entire amount of first coating solution was sprayed onto the bleach granules through a Gustav Schlick Nozzle, Model 941, at an atomized air pressure of 40 psig to form once bleach coated particles.

Into the now empty 32 liter container was placed 2.27 kg KLUCEL J, a hydroxypropylcellulose purchased from Hercules, Inc., and 70.94 kg water to form a second coating solution. The bed temperature was adjusted to 69°–71° C. and the entire amount of second coating solution sprayed onto the once coated bleach particles through the Gustav Schlick nozzle to form twice-coated, protectively encapsulated bleach particles. The bed temperature was then adjusted to 74° C. and the protectively encapsulated dichloroisocyanurate monohydrate bleach particles dried. The process yielded 20.13 kg of protectively encapsulated bleach particles comprising 55.0 wt-% core of bleach, 35 wt-% first coat of a mixture of 75 wt-% sodium sulfate and 25 wt-% sodium tripolyphosphate hexahydrate and 10 wt-% second coat of KLUCEL J.

EXAMPLE 8

Into a 32 liter container was placed 7.26 kg granular sodium sulfate, 2.42 kg sodium tripolyphosphate and 30.36 kg water to form a first coating solution.

Into a fluidized bed was placed 12.25 kg of a granular dichloroisocyanurate dihydrate (hereinafter bleach)

which can be purchased from a number of sources. The bleach was fluidized with air and the bed heated to 63°-71° C. The entire amount of first coating solution was sprayed onto the bleach granules through a Gustav Schlick Nozzle, Model 941, at an atomized air pressure of 40 psig to form once coated bleach particles.

Into the now empty 32 liter container was placed 1.13 kg KLUCEL J, a hydroxypropylcellulose purchased from Hercules, Inc., and 35.51 kg water to form a second coating solution. The bed temperature was adjusted to 48°-52° C. and the entire amount of second coating solution sprayed onto the once coated bleach particles through the Gustav Schlick nozzle to form twice-coated, protectively encapsulated bleach particles. The bed temperature was then adjusted to 71° C. and the protectively encapsulated bleach particles dried. The process yielded 21.95 kg of protectively encapsulated bleach particles comprising about 50 wt-% core of dichloroisocyanurate monohydrate bleach, 45 wt-% first coat of a mixture of 71 wt-% sodium sulfate and 29 wt-% sodium tripolyphosphate hexahydrate and 5 wt-% second coat of KLUCEL J.

EXAMPLE 9

Into a mixing vessel was placed 4.77 parts granular sodium sulfate, 1.59 parts sodium tripolyphosphate and 19.93 parts water to form a first coating solution.

Into a fluidized bed was placed 10.05 parts bleach, a granular dichloroisocyanurate dihydrate (hereinafter bleach) which can be purchased from a number of sources. The bleach was fluidized with air and the bed heated.

Into the now empty mixing vessel was placed 9.77 parts of an n-octyl sulfonate (40 wt-% n-octyl sulfonate, 60 wt-% water) to form a second coating solution. This second coating solution was diluted with 9.88 parts of soft water. This solution was sprayed onto the heated bed of particles to form twice coated protectively encapsulated bleach particles.

Into the now empty 32 liter container was placed 2.00 parts KLUCEL J, a hydroxypropylcellulose purchased from Hercules, Inc., and 63.00 parts water to form a third coating solution. The bed temperature was adjusted to 56°-64° C. and the entire amount of third coating solution sprayed onto the twice coated bleach particles through the Gustav Schlick nozzle to form thrice coated, protectively encapsulated bleach particles. The bed temperature was then adjusted to 66° C. and the protectively encapsulated bleach particles dried. The process yielded 17.5 parts of protectively encapsulated bleach particles comprising about 43 wt-% core of dichloroisocyanurate monohydrate bleach, 31 wt-% first coat of a mixture of 71 wt-% sodium sulfate and 29 wt-% sodium tripolyphosphate hexahydrate, a second coat of 18 wt-% sodium n-octyl sulfonate and 9 wt-% third coat of KLUCEL J.

I claim:

1. A solid cast warewashing composition which comprises:

(a) about 20 to 55 wt-%, based upon the solid cast warewashing composition and calculated on an anhydrous basis, of a hydratable, crystalline alkali metal silicate composition;

(b) about 1 to 70 wt-%, based upon the solid cast warewashing composition, of an alkali metal condensed phosphate composition, having sufficient water of hydration to allow the cast warewashing composition to solidify;

(c) about 0.2 to 20 wt-%, based upon the solid cast warewashing composition, of an encapsulated bleaching source which comprises:

(i) a bleaching agent core;

(ii) an inner coating of a separating compound in an amount sufficient to retard any chemical interaction between the bleaching agent core and an outer coating compound; and (iii) an outer coating of an encapsulating amount of a water soluble cellulose ether compound selected from the group consisting of ($C_{1-4}$) alkyl cellulose, carboxy ($C_{1-4}$) alkyl cellulose, hydroxy ($C_{1-4}$) alkyl cellulose, carboxy ($C_{1-4}$) alkyl hydroxy ($C_{1-4}$) alkyl cellulose, ($C_{1-4}$) alkyl hydroxy ($C_{1-4}$) alkyl cellulose, and mixtures thereof; and (d) about 8 to 60 wt-%, based upon the solid cast warewashing composition, water.

2. The solid cast warewashing composition of claim 1 wherein the inner coating compound of the encapsulated bleaching source comprises a water-soluble coating compound.

3. The solid cast warewashing composition of claim 1 wherein the bleaching agent core comprises a core of an active chlorine releasing bleach.

4. The solid cast warewashing composition of claim 1 wherein the hydratable crystalline alkali metal silicate has the formula $(M_2O)_x:(SiO_2)_y$ wherein M is an alkali metal and the ratio of x:y is about 1:1 to about 3:1.

5. The solid cast warewashing composition of claim 1 wherein the alkali metal condensed phosphate composition is hydrated.

6. The solid cast warewashing composition of claim 1 wherein the alkali metal condensed phosphate comprises a hydrated alkali metal tripolyphosphate.

7. A solid cast warewashing composition which comprises:

(a) about 20 to 40 wt-%, based upon the solid cast warewashing composition and calculated on an anhydrous basis, of a hydratable, crystalline alkali metal silicate composition;

(b) about 15 to 40 wt-%, based upon the solid cast warewashing composition, of an alkali metal condensed phosphate composition, having sufficient water of hydration to allow the cast warewashing composition to solidify;

(c) about 0.1 to 15 wt-%, based upon the solid cast warewashing composition, of an encapsulated bleaching source which comprises:

(i) a bleaching agent core;

(ii) an inner coating of a separating compound in an amount sufficient to retard any chemical interaction between the bleaching agent core and an outer coating compound; and (iii) an outer coating of an encapsulating amount of a water soluble cellulose ether compound selected from the group consisting of ($C_{1-4}$) alkyl cellulose, carboxy ($C_{1-4}$) alkyl cellulose, hydroxy ($C_{1-4}$) alkyl cellulose, carboxy ($C_{1-4}$) alkyl hydroxy ($C_{1-4}$) alkyl cellulose, ($C_{1-4}$) alkyl hydroxy ($C_{1-4}$) alkyl cellulose, and mixtures thereof; and (d) about 8 to 35 wt-%, based upon the solid cast warewashing composition, water.

8. The solid cast warewashing composition of claim 7 wherein the inner coating compound of the encapsulated bleaching source comprises a water-soluble coating compound.

9. The solid cast warewashing composition of claim 7 wherein the bleaching agent core comprises a core of an active chlorine releasing bleach.

10. The solid cast warewashing composition of claim 7 wherein the hydratable crystalline alkali metal silicate has the formula $(M_2O)_x:(SiO_2)_y$ wherein M is an alkali metal and the ratio of x:y is about 1:1 to about 3:1.

11. The solid cast warewashing composition of claim 7 wherein the alkali metal condensed phosphate composition is hydrated.

12. The solid cast warewashing composition of claim 7 wherein the alkali metal condensed phosphate comprises a hydrated alkali metal tripolyphosphate.

13. A method of cleaning ware which comprises the steps of:

(a) contacting a solid cast warewashing composition and water to form an aqueous cleaning solution; and (b) contacting soiled ware with the cleaning solution so as to remove soil from the soiled ware; wherein the solid cast warewashing composition comprises:

(i) about 20 to 55 wt-%, based upon the solid cast warewashing composition and calculated on an anhydrous basis, of a hydratable, crystalline alkali metal silicate;

(ii) about 1 to 70 wt-%, based upon the solid cast warewashing composition, of an alkali metal condensed phosphate composition, having sufficient water of hydration to allow the cast warewashing composition to solidify; and (iii) about 0.1 to 20 wt-%, based upon the solid cast warewashing composition, of an encapsulated bleaching source which comprises:

(1) a bleaching agent core;

(2) an inner coating of a separating compound in an amount sufficient to retard any chemical interaction between the bleaching agent core and an outer coating compound; and (3) an outer coating of an encapsulating amount of a water soluble cellulose ether compound selected from the group consisting of $(C_{1-4})$ alkyl cellulose, carboxy $(C_{1-4})$ alkyl cellulose, hydroxy $(C_{1-4})$ alkyl cellulose, carboxy $(C_{1-4})$ alkyl hydroxy $(C_{1-4})$ alkyl cellulose, $(C_{1-4})$ alkyl hydroxy $(C_{1-4})$ alkyl cellulose, and mixtures thereof; and (iv) about 8 to 60 wt-% water, based upon the solid cast warewashing composition.

14. The method of claim 13 wherein the inner coating compound of the encapsulated bleaching source comprises a water-soluble coating compound.

15. The method of claim 13 wherein the bleaching agent core comprises a core of an active chlorine releasing bleach.

16. The method of claim 13 wherein the solid cast warewashing composition comprises (i) about 20 to 40 wt-%, based upon the solid cast warewashing composition and calculated on an anhydrous basis, of the hydratable, crystalline alkali metal silicate and (ii) about 15 to 40 wt-%, based upon the solid cast warewashing composition, of the alkali metal condensed phosphate having sufficient water of hydration to allow the cast warewashing composition to solidify.

17. The method of claim 13 wherein the hydratable crystalline alkali metal silicate has the formula $(M_2O)_x:(SiO_2)_y$ wherein M is an alkali metal and the ratio of x:y is about 1:1 to about 3:1.

18. The method of claim 13 wherein the alkali metal condensed phosphate composition is hydrated.

19. The method of claim 13 wherein the alkali metal condensed phosphate comprises a hydrated alkali metal tripolyphosphate.

20. A method of making a solid cast warewashing composition which comprises the steps of:

(a) combining about 8 to 60 wt-%, based upon the solid cast warewashing composition, water and about 20 to 55 wt-%, based upon the solid cast warewashing composition, of a hydratable, crystalline alkali metal silicate composition to form an aqueous composition;

(b) heating the aqueous composition to a temperature of about 35° C. to 99° C.;

(c) cooling the hydrated alkali metal silicate to a temperature below about 65° C.;

(d) combining about 1 to 70 wt-%, based upon the solid cast warewashing composition, alkali metal condensed phosphate composition having sufficient water of hydration to allow the cast warewashing composition to solidify, and the cooled hydrated alkali metal silicate composition to form a mixture;

(e) cooling the mixture to below about 55° C.;

(f) combining the cooled mixture and about 0.1 to 20 wt-%, based upon the solid cast warewashing composition, of an encapsulated bleaching source to form a liquid detergent composition; the encapsulated bleaching source comprising:

(i) a bleaching agent core;

(ii) an inner coating of a separating compound in an amount sufficient to retard any chemical interaction between the bleaching agent core and an outer coating compound; and (iii) an outer coating of an encapsulating amount of a water soluble cellulose ether compound selected from the group consisting of $(C_{1-4})$ alkyl cellulose, carboxy $(C_{1-4})$ alkyl cellulose, hydroxy $(C_{1-4})$ alkyl cellulose, carboxy $(C_{1-4})$ alkyl hydroxy $(C_{1-4})$ alkyl cellulose, $(C_{1-4})$ alkyl hydroxy $(C_{1-4})$ alkyl cellulose, and mixtures thereof; and (g) casting the liquid detergent composition into a container to form the solid cast warewashing composition.

21. The solid cast warewashing composition of claim 20 wherein the inner coating compound of the encapsulated bleaching source comprises a water-soluble coating compound.

22. The method of claim 20 wherein the bleaching agent core comprises a core of an active chlorine source.

23. The method of claim 20 further comprising the step of combining about 0.1 to 10 wt-%, based upon the solid cast warewashing composition, of a dye with the composition after step (b).

24. The method of claim 20 further comprising the step of combining about 0.1 to 10 wt-%, based upon the solid cast warewashing composition, of a perfume with the composition after step (f).

25. The method of claim 20 further comprising the step of combining about 0.1 to 15 wt-%, based upon the solid cast warewashing composition, of a surfactant with the composition after step (b).

26. The method of claim 20 further comprising the step of combining about 0.1 to 20 wt-%, based upon the solid cast warewashing composition, of an alkali metal salt of a polyacrylic acid compound with the composition after step (b).

27. The method of claim 20 further comprising the step of combining about 0.1 to 20 wt-%, based upon the solid cast warewashing composition of a neutral soluble salt selected from the group consisting of an alkali metal sulfate and an alkali metal chloride compound with the composition after step (b).

28. The method of claim 20 further comprising the step of combining about 0.1 to 15 wt-%, based upon the solid cast warewashing composition, of a defoamer with the composition after step (b).

29. The method of claim 20 further comprising the step of combining about 0 to 30 wt-%, based upon the solid cast warewashing composition, of an alkali compound selected from the group consisting of alkali metal hydroxides, soluble alkali metal silicates with the formula $(M_2O)_x:(SiO_2)_y$ wherein M is an alkali metal and the ratio of x:y is about 1.0:1.6 to 1.0:3.75, alkali metal carbonates, alkali metal bicarbonates, alkali metal sesquicarbonates, alkali metal borates and mixtures thereof with the composition after step (b).

30. The method of claim 20 wherein the alkali metal condensed phosphate has a particle size of about 10 to 40 U.S. Mesh.

31. The method of claim 20 wherein the cast liquid detergent composition is mixed in the container before solidifying.

32. The method of claim 20 wherein the encapsulated bleaching source and the cooled mixture are combined by dispersing the encapsulated bleaching source in the mixture prior to casting.

33. The method of claim 20 wherein (i) about 8 to 35 wt-%, based upon the solid cast warewashing composition, water and about 20 to 40 wt-%, based upon the solid cast warewashing composition, hydratable, crystalline alkali metal silicate composition are combined to form the aqueous composition, and (ii) about 15 to 40 wt-%, based upon the solid cast warewashing composition, alkali metal condensed phosphate composition having sufficient water of hydration to allow the cast warewashing composition to solidify, is combined with the cooled hydrated alkali metal silicate composition to form the mixture, and (iii) about 0.1 to 15 wt-%, based upon the solid cast warewashing composition, encapsulated bleaching source is combined with the cooled mixture to form the liquid detergent composition.

34. The method of claim 20 wherein the aqueous composition is heated to about 65° C. to 85° C. for at least 10 minutes.

35. The method of claim 20 further comprising the step of combining about 0.1 to 20 wt-%, based upon the solid cast warewashing composition, of an alkali metal salt of a polyacrylic acid compound with the composition prior to the addition of the encapsulate.

36. The method of claim 20 wherein the alkali metal condensed phosphate composition is hydrated.

37. The method of claim 20 wherein the mixture is cooled to about 48° to 55° C.

* * * * *

UNITED STATES PATENT AND TRADEMARK OFFICE

CERTIFICATE OF CORRECTION

PATENT NO. : 4,933,102

DATED : June 12, 1990

INVENTOR(S) : KEITH E. OLSON

It is certified that error appears in the above-identified patent and that said Letters Patent is hereby corrected as shown below:

In the "Abstract", item [57], line 13, before "sesquicarbonate" insert --carbonate, an alkali metal bicarbonate, an alkali metal--.
Column 12, line 1, for "0.2" read --0.1--.

Signed and Sealed this

Third Day of September, 1991

*Attest:*

*Attesting Officer*

HARRY F. MANBECK, JR.

*Commissioner of Patents and Trademarks*